US007084811B1

(12) United States Patent
Yap

(10) Patent No.: US 7,084,811 B1
(45) Date of Patent: Aug. 1, 2006

(54) AGILE OPTICAL WAVELENGTH SELECTION FOR ANTENNA BEAMFORMING

(75) Inventor: Daniel Yap, Newbury Park, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 10/941,256

(22) Filed: Sep. 14, 2004

(51) Int. Cl.
*H01Q 3/22* (2006.01)

(52) U.S. Cl. ..... 342/375; 342/373; 342/374

(58) Field of Classification Search ..... 342/372, 342/373, 374, 375
See application file for complete search history.

(56) References Cited

U.S. PATENT DOCUMENTS

| | | | | |
|---|---|---|---|---|
| 5,428,814 | A * | 6/1995 | Mort et al. | 455/12.1 |
| 5,504,774 | A * | 4/1996 | Takai et al. | 375/134 |
| 5,861,845 | A | 1/1999 | Lee et al. | 342/375 |
| 5,933,113 | A | 8/1999 | Newberg et al. | 342/375 |
| 5,999,128 | A | 12/1999 | Stephens et al. | 342/375 |
| 6,348,890 | B1 | 2/2002 | Stephens | 342/375 |
| 6,452,546 | B1 | 9/2002 | Stephens | 342/368 |
| 6,731,829 | B1 * | 5/2004 | Ionov | 385/15 |
| 2001/0038318 | A1 * | 11/2001 | Johnson et al. | 331/135 |
| 2002/0021464 | A1 * | 2/2002 | Way | 359/124 |
| 2003/0003961 | A1 * | 1/2003 | Li et al. | 455/562 |
| 2003/0080898 | A1 * | 5/2003 | Wang et al. | 342/359 |
| 2004/0264977 | A1 * | 12/2004 | Yap et al. | 398/161 |

OTHER PUBLICATIONS

Chang, K., *Handbook of Microwave and Optical Components*, John Wiley and Sons, pp. 595-626, 670-674 (1989).
Oda, K., et al., "A Wide-FSR Waveguide Double-Ring Resonator for Optical FDM Transmission Systems," *Journal of Lightwave Technology*, vol. 9, No. 6, pp. 728-736 (Jun. 1991).
Zmuda, H., et al., "Photonic Beamformer for Phased Array Antennas Using a Fiber Grating Prism," *IEEE Photonics Technology Letters*, vol. 9, No. 2, pp. 241-243 (Feb. 1997).
U.S. Appl. No. 10/696,607, filed Oct. 28, 2003, Yap.

* cited by examiner

*Primary Examiner*—Dao Phan
(74) *Attorney, Agent, or Firm*—Ladas & Parry LLP

(57) ABSTRACT

An antenna beamformer consisting of optical irises coupled to Wavelength Division Multiplexers (WDMs). The ports of the WDMs are coupled to lens ports, where each lens port corresponds to a different antenna beam. The optical irises are optical filters with selectable center frequencies and selectable passband widths. Selection of different center frequencies and passband widths enables the selection of different ports of the WDMs, which allows the selection of one or more antenna beams. The beamformer may also have controllable delay lines to provide for additional beam steering.

48 Claims, 6 Drawing Sheets

AGILE OPTICAL WAVELENGTH SELECTION FOR ANTENNA BEAMFORMING

BACKGROUND

1. Field

The present disclosure relates to steerable antennas such as phase arrays. More specifically, the disclosure relates to a beamforming architecture and a method for forming beams of an array antenna that use radio frequency lens beamformers and a multi-wavelength photonic network with optical irises.

2. Description of Related Art

Phased array antenna systems are widely used in radar, electronic warfare, and radio frequency communication systems. Phased array antenna systems are characterized by the capability to steer one or more antenna beams of the antenna system by controlling the phase of the radio waves transmitted and received by each radiating element of the antenna system. Hence, a phased array antenna system does not have to be mechanically moved to provide antenna beams that move either horizontally, vertically, or in both directions.

Radio Frequency (RF) lens beamformers are known in the art and are commonly used for antenna systems. RF Lens beamformers generally comprise RF radiators positioned at the front face of the lens structure and one or more input ports positioned at the rear face of the lens structure. Typically, each input port provides RF energy to all of the radiators, but each input port is located so that the phase of the RF energy arriving at the radiators differs among the input ports. Hence, each input port provides a different antenna beam from the RF lens beamformer. RF lens beamformers known in the art include Rotman lenses, R/2R lenses, and Luneberg lenses.

U.S. Pat. No. 5,861,845, issued Jan. 19, 1999 to Lee et al., describes a wideband phased array antenna in which one embodiment uses a Rotman lens to provide a reference manifold to provide reference signal samples that are progressively time delayed. The Rotman lens may comprise an electric Rotman lens with antennas positioned on both faces of the lens or an optical Rotman lens with optical generators located on a first face and photodetectors located on a second face. The use of the Rotman lens in U.S. Pat. No. 5,861,845 highlights the capability of lens structures to provide different scanning path lengths from selected input ports to output ports.

U.S. Pat. No. 5,999,128, issued Dec. 7, 1999 to Stephens et al., describes a phased array antenna system that generates multiple independently controlled antenna beams. The phased array antenna has photonic manifolds comprising optical delay paths. Multiple antenna beams are generated by applying frequency-swept scanning signals and reference signals through the manifolds to radiative modules. Each pair of scanning and reference signals generates one of the antenna beams. The antenna beam is scanned by changing the frequency of the scanning signal. However, even though the system described in U.S. Pat. No. 5,999,128 provides multiple antenna beams, each antenna beam can generally only be coupled to a single source (i.e., transmitter) or destination (i.e., receiver). Combination of multiple beams for a single source or destination would generally require additional combinatorial circuitry.

U.S. Pat. No. 6,452,546, issued Sep. 17, 2002 to Stephens, describes phased array antenna systems that provide multiple antenna beams. Wavelength division multiplexing (WDM) networks are used to direct beam signals to selected time delay lines to provide the appropriate control over the beams. U.S. Pat. No. 6,348,890, issued Feb. 19, 2002 to Stephens, incorporated herein by reference, also describes the use of WDM networks to direct beam signals in a phased array antenna system. These patents show the desirability of optically-based antenna systems using WDM components to provide control over multiple antenna beams.

As noted above, prior art multiple beam phased antenna systems typically provide that each antenna beam may only be coupled to a single source or destination, unless additional combinatorial circuitry is used, which further complicates the architecture of such a system. Therefore, there is a need in the art for a multiple beam phased array antenna system that allows a receiver or transmitter to access multiple beams.

SUMMARY

Embodiments of the phased array antenna system described in the present specification make use of different optical wavelengths to select different beams provided by a RF lens beamformer, such as a Rotman lens, or by optical implementations of such RF beamformers. An optical wavelength sliding iris is used to enable the selection of groups of lens ports in an agile manner. Each lens port typically corresponds to a different beam produced by the phased array antenna at a different angle. The optical iris is used in combination with a multiple wavelength optical source (or multiple optical sources of different wavelengths) and optical wavelength division multiplexers/demultiplexers. The optical iris is preferably an optical filter whose center wavelength(s) and passband width(s) can be tuned to allow the selection of a desired optical wavelength or set of wavelengths.

Embodiments of the described phased array antenna system may have additional switched optical delay lines to provide for additional steering of the antenna beams corresponding to each lens port. The switched delay lines may also provide the ability to achieve steering in other directions. The switched delay lines are preferably located between the optical iris and the RF lens.

The optical iris used in embodiments of the described phased array antenna system allows the antenna system to adjust the effective beam width associated with a given waveform Exciter or Receiver according to operation modes of the antenna system. For example, it is generally preferred that radar systems operating in a search mode have a narrow effective beam, so that optical iris can be configured to provide such a beam. Alternatively, it is preferred for radar systems operating in a track mode that the beam is wider, so the optical iris can be configured to provide that result. Further, for wideband or multi-band signals and smaller RF lenses, whose size is on the order of the wavelength of the lower signal frequencies, the optical iris may be adjusted for different signal frequencies to compensate for diffraction or inter-port coupling effects. These effects can cause the signal to overlap multiple ports of the RF lens, with the number of ports greater as the frequency is lower.

In still other embodiments according to the present invention, the optical iris may be adjusted to select several, discontinuous antenna beams. The combination of several antenna beams, discontinuous or not, may be considered as forming a composite antenna beam for transmission and/or reception.

DETAILED DESCRIPTION

Embodiments of the present invention provide beamforming systems and methods for forming beams with an array antenna that makes use of RF lens beamformers (such as Rotman lenses, R/2R lenses or Luneberg lenses) and a multi-wavelength photonic network with optical irises. The beamforming systems and methods also may include switched optical delay lines that are cascaded with the RF lenses. The RF lens beamformers may be implemented as well-known RF structures (such as those described in pages 595–626 of the *Handbook of Microwave and Optical Components, Volume* 1, edited by K. Chang, J. Wiley & Sons, 1989). The RF beamformers may also be provided by an optical implementation as described in U.S. Pat. No. 6,452,546, issued Sep. 17, 2002 to Stephens, incorporated herein by reference in its entirety.

Generally, a RF lens beamformer has a set of ports on one side, with those ports connected to the array of antenna elements. The RF lens has a second set of ports located on the other side of the lens that define different beam angles. Planar (2-D) RF lenses (such as the Rotman lens) form beams along one axis (e.g., in azimuth). Volume (3-D) RF lenses (such as the Luneberg lens) can form beams along two axes (e.g., in both azimuth and elevation). Two-axis beamforming also can be accomplished with planar lenses by using one of two methods. In the first method, an array of planar lenses that form the beam in one axis is cascaded with a second beamformer (such as switched optical delay lines) that forms the beam in the other axis. In the second method, two arrays of planar lenses are cascaded, with one array forming the beam in one axis (e.g., azimuth) and the other array forming the beam in the other axis (e.g., elevation).

Figure 1:
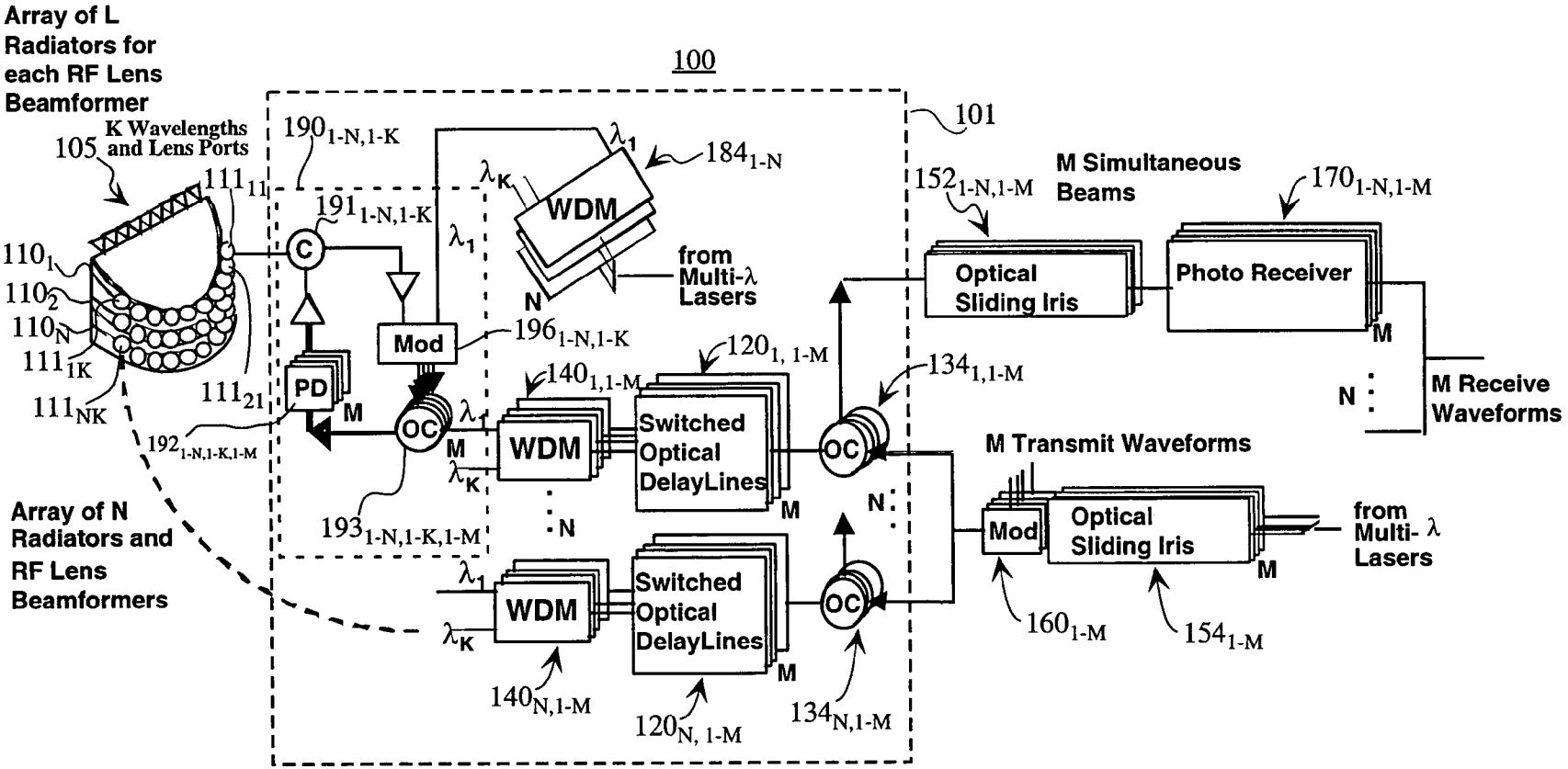
FIG. 1 shows a generalized block diagram of a beam forming system according to an embodiment of the present invention.

FIG. 1 illustrates an embodiment of the present invention that provides a beamforming system 100 having an array 105 coupled to optical irises $\mathbf{152}_{1\text{-}N,1\text{-}M}$, $\mathbf{154}_{1\text{-}M}$ by a distribution network 101. The system 100 cascades an array of planar RF lenses $\mathbf{110}_{1\text{-}N}$ in the array 105 with an optional second beamformer comprising switched optical delay lines $\mathbf{120}_{1\text{-}N,1\text{-}M}$. The switched optical delay lines $\mathbf{120}_{1\text{-}N,1\text{-}M}$ have path lengths that may be determined by a set of optical switches. The path length switching is not dependent on the optical wavelength and a large range of optical wavelengths may be carried in the delay lines $\mathbf{120}_{1\text{-}N,1\text{-}M}$. The RF lenses $\mathbf{110}_{1\text{-}N}$ as well as the switched optical delay lines $\mathbf{120}_{1\text{-}N,1\text{-}M}$ are bi-directional and can be used for both antenna transmit and receive functions. Bi-directional operation is further accomplished by using RF circulators $\mathbf{191}_{1\text{-}N,1\text{-}K}$ and optical circulators $\mathbf{193}_{1\text{-}N,1\text{-}K,1\text{-}M}$, $\mathbf{134}_{1\text{-}N,1\text{-}M}$.

In the embodiment depicted in FIG. 1, each beam-angle port $\mathbf{111}_{1\text{-}N,1\text{-}K}$ (hereafter referred to as port) of a RF lens $\mathbf{110}_{1\text{-}N}$ is associated with a different optical wavelength. A given lens port $\mathbf{111}_{1\text{-}N,1\text{-}K}$ is accessed by means of optical wavelength demultiplexers/multiplexers (WDM) $\mathbf{140}_{1\text{-}N,1\text{-}M}$, $\mathbf{184}_{1\text{-}N}$, as shown in FIG. 1. The WDMs $\mathbf{140}_{1\text{-}N,1\text{-}M}$, $\mathbf{184}_{1\text{-}N}$ may be arrayed waveguide gratings (AWGs) or other WDM devices known in the art. Different RF lenses $\mathbf{110}_{1\text{-}N}$ use the same set of optical wavelengths but those lenses are associated with different WDMs $^{140}{}_{1\text{-}N,1\text{-}M}$ (for Transmit signals) and WDMs $\mathbf{140}_{1\text{-}N,1\text{-}M}$, WDMs $\mathbf{184}_{1\text{-}N}$ (for Receive signals) and switched optical delay lines $\mathbf{120}_{1\text{-}N,1\text{-}M}$. Each of M multiple simultaneous beams is associated with a different set of WDMs $\mathbf{140}_{1\text{-}N,1\text{-}M}$ and switched optical delay lines $\mathbf{120}_{1\text{-}N,1\text{-}M}$ as well as a different set of optical sliding irises $\mathbf{152}_{1\text{-}N,1\text{-}M}$, $\mathbf{154}_{1\text{-}M}$, optical modulators $\mathbf{160}_{1\text{-}M}$ and photoreceivers $\mathbf{170}_{1\text{-}N,1\text{-}M}$. The switched optical delay lines $\mathbf{120}_{1\text{-}N,1\text{-}M}$ may be part of a photonic true-time-delay (TTD) module (not shown in FIG. 1).

Whether receiving or transmitting a signal, the system 100 uses optical wavelength to select different ports $\mathbf{111}_{1\text{-}N,\ 1\text{-}K}$ (or different groups of ports) of the RF lens beamformer $\mathbf{110}_{1\text{-}N}$. Each port $\mathbf{111}_{1\text{-}N,\ 1\text{-}K}$ is associated with a different optical wavelength. FIG. 1 shows each lens $\mathbf{110}_{1\text{-}N}$ as having K ports $\mathbf{111}_{1\text{-}N,\ 1\text{-}K}$ and, therefore, K different wavelengths.

When the antenna array 105 is receiving signals, the RF signal at a given port $\mathbf{111}_{1\text{-}N,\ 1\text{-}K}$ is modulated onto an optical carrier by a modulator $\mathbf{196}_{1\text{-}N,1\text{-}K}$ having the wavelength associated with that port $\mathbf{111}_{1\text{-}N,\ 1\text{-}K}$. Optical carriers at different wavelengths may be obtained from one or more WDMs $\mathbf{184}_{1\text{-}N}$ coupled to a laser source that generates the multiple wavelengths. Preferably, the optical carriers at those multiple wavelengths are not coherent with each other. The RF-modulated optical signals from all of the ports $\mathbf{111}_{1\text{-}N,\ 1\text{-}K}$ of a given lens $\mathbf{110}_{1\text{-}N}$ are multiplexed together with a WDM $\mathbf{140}_{1\text{-}N,\ 1\text{-}M}$ onto the same optical fiber and routed together through to the switched optical delay lines $\mathbf{120}_{1\text{-}N,1\text{-}M}$.

This multiplexing maintains the distinction between the received signals, since they are at different optical wavelengths. The multiplexed signal is split M ways, where M is the number of simultaneous beams, and may be directed to M sets of the switched optical delay lines $\mathbf{120}_{1\text{-}N,\ 1\text{-}M}$. A set of photoreceivers $\mathbf{170}_{1\text{-}N,\ 1\text{-}M}$, preceded by wavelength-tunable optical irises $\mathbf{152}_{1\text{-}N,\ 1\text{-}M}$, is associated with each of the M beams. There could be as many photoreceivers $\mathbf{170}_{1\text{-}N,\ 1\text{-}M}$ in a set as there are rows of elements, N, in the antenna array 105. Each optical iris $\mathbf{152}_{1\text{-}N,\ 1\text{-}M}$ is an optical filter whose center wavelength(s) and bandwidth(s) are tunable. Tuning of the filter bandwidth allows selection and inclusion of one or multiple RF lens ports $\mathbf{111}_{1\text{-}N,\ 1\text{-}K}$, with increasingly more ports selected as the bandwidth is enlarged. Tuning of the filter's center wavelength selects the specific port(s) and, thus, the beam angle(s). For antenna Receive functions, the received energy may be distributed among multiple lens ports $\mathbf{111}_{1\text{-}N,\ 1\text{-}K}$, depending on the frequency of the received RF signal and the size of the lens. By using the optical iris $\mathbf{152}_{1\text{-}N,\ 1\text{-}M}$, the receiver is capable of both fine angular resolution (e.g., at high signal frequencies) and efficient collection of energy (e.g., at low signal frequencies), although generally not concurrently. This permits the receiver to accomplish both search and track functions using the large frequency range.

When RF-modulated light at multiple wavelengths (i.e., from multiple lens ports) is detected by a photodetector $\mathbf{170}_{1\text{-}N,\ 1\text{-}M}$, the RF portions of those signals are combined and summed coherently, with preservation of their phase information. A photodetector $\mathbf{170}_{1\text{-}N,\ 1\text{-}M}$ optically heterodynes the multiple optical signal components that are at the multiple wavelengths to provide the coherently summed signal. For this optical heterodyning to be accomplished successfully, the spacing of those wavelengths is preferably larger than the response bandwidth of the photodetector $\mathbf{170}_{1\text{-}N,\ 1\text{-}M}$ in the photoreceiver. As an example, the photodetector bandwidth can be 12–15 GHz and the optical-wavelength spacing can be 50 GHz. The summing of the RF signals captures the energy from multiple lens ports $\mathbf{111}_{1\text{-}N,\ 1\text{-}K}$. One can determine the angle of the received beam by monitoring the center wavelength of the optical iris and measuring the amount of energy received. When fine angular resolution is desired, the passband of the optical iris $\mathbf{152}_{1\text{-}N,\ 1\text{-}M}$ may be narrowed to select only a single wavelength (and a single lens port). This improved resolution may be accompanied, however, by a reduction of the energy captured for frequency components that are low compared to the size of the RF lens.

When transmitting a signal or signals, a multiple wavelength laser source (or alternatively a set of single wavelength lasers) supplies one or more optical carriers. The optical iris $\mathbf{154}_{1\text{-}M}$ then selects the desired wavelength(s) of the optical carrier(s) and one or more modulators $\mathbf{160}_{1\text{-}M}$ are used to modulate the optical carrier(s) with the transmit signal(s). The combination of the switched optical delay lines $\mathbf{120}_{1\text{-}N,1\text{-}M}$ and the WDMs $\mathbf{140}_{1\text{-}N,\ 1\text{-}M}$ then direct the transmit signal(s) to photodetectors $\mathbf{192}_{1\text{-}N,\ 1\text{-}K}$ to selected ports $\mathbf{111}_{1\text{-}N,\ 1\text{-}K}$ after conversion to electrical signal(s) by photodetectors $\mathbf{192}_{1\text{-}N,\ 1\text{-}K,1\text{-}M}$. Note that the arrangement of the optical iris $\mathbf{154}_{1\text{-}M}$ and the modulator $\mathbf{160}_{1\text{-}M}$ can be reversed so that the modulator $\mathbf{160}_{1\text{-}M}$ precedes the iris $\mathbf{154}_{1\text{-}M}$.

To show how the system 100 may control a beam in both the azimuth and elevation directions, assume the system 100 is configured so that the RF lenses $\mathbf{110}_{1\text{-}N}$ define the beam angle in azimuth and the switched delay lines $\mathbf{120}_{1\text{-}N,\ 1\text{-}M}$ define the beam angle in elevation. Different beams could have the same azimuth angle and excite the same group of lens ports $\mathbf{111}_{1\text{-}N,\ 1\text{-}K}$. Those beams, however, would have different optical time delays produced by the switched delay lines $\mathbf{120}_{1\text{-}N,\ 1\text{-}M}$ (since they would have different elevation angles).

As a further example, consider a system 100 that produces 40 different beam angles in azimuth and 20 different beam angles in elevation. Each of the RF lenses $\mathbf{110}_{1\text{-}N}$ has 40 ports 111 (K=40) and the antenna array 105 has an array of 20 lenses $\mathbf{110}_{1\text{-}N}$ (N=20). The 40 ports $\mathbf{111}_{1\text{-}N,\ 1\text{-}K}$ are associated with 40 optical wavelengths, with the same wavelength used for the same corresponding port $\mathbf{111}_{1\text{-}N,\ 1\text{-}K}$ in each of the RF lenses $\mathbf{110}_{1\text{-}N}$ in the array. The RF signal for each group of ports $\mathbf{111}_{1\text{-}N,\ 1\text{-}K}$ is modulated onto the optical carrier of the appropriate wavelength. If a maximum signal bandwidth of 12–15 GHz is assumed, the optical wavelengths can be spaced by 50 GHz. Such a wavelength spacing follows the standard established for commercial wavelength-division-multiplexed telecommunications networks. Consequently, commercially available wavelength demultiplexers/multiplexers $\mathbf{140}_{1\text{-}N,\ 1\text{-}M}$, $\mathbf{184}_{1\text{-}N}$ and laser sources can be used. Commercial AWG devices having 40 channels with 50 GHz spacing have become readily available and 80-channel devices are anticipated soon for large-volume commercial applications.

The elevation steering, in this example, is performed by applying optical true-time delays to the RF-signal modulated light. These optical delays are applied prior to the RF delays (produced by the RF lens) for azimuth steering on Transmit and after the RF delays on Receive. In the example above, the system would require 20 separate optical delays, for the 20 lenses, for each simultaneous beam. If there are 10 simultaneous beams (M=10), 200 separate delays would be needed. Each delay can be adjusted to produce the RF phase shift appropriate for the desired elevation angle.

Preferably, the system 100 in the example discussed above has a multi-wavelength laser source that is capable of supplying the 40 mutually incoherent wavelengths desired for selection of the RF lens ports. As indicated above, an alternative to the multi-wavelength laser source is the use of 40 separate single-wavelength lasers. Such single-wavelength devices are available commercially and the multiple wavelength devices have been demonstrated by research groups and should become available soon. For the 20 separate antenna patterns or beams, 20 multi-wavelength, tunable photonic links are needed, with 10 links for Transmit and 10 links for Receive. Each tunable photonic link receives light from the multi-wavelength laser source. Each link contains a set of wavelength-agile optical irises $\mathbf{152}_{1\text{-}N,\ 1\text{-}M}$, $\mathbf{154}_{1\text{-}M}$, an optical modulator $\mathbf{160}_{1\text{-}M}$ and M photodetectors for Transmit or one photodetector $\mathbf{170}_{1\text{-}N,\ 1\text{-}M}$ for Receive. The links also contain 1:N optical splitters $\mathbf{162}_{1\text{-}M}$, WDMs$_{1\text{-}N,\ 1\text{-}M}$ and optical circulators $\mathbf{134}_{1\text{-}N,\ 1\text{-}M}$. All of these components except the optical iris are available commercially. The optical iris, however, can be constructed from commercially available components, as described later. Finally, each link includes a switched optical delay line $\mathbf{120}_{1\text{-}N,\ 1\text{-}M}$.

Figure 2:
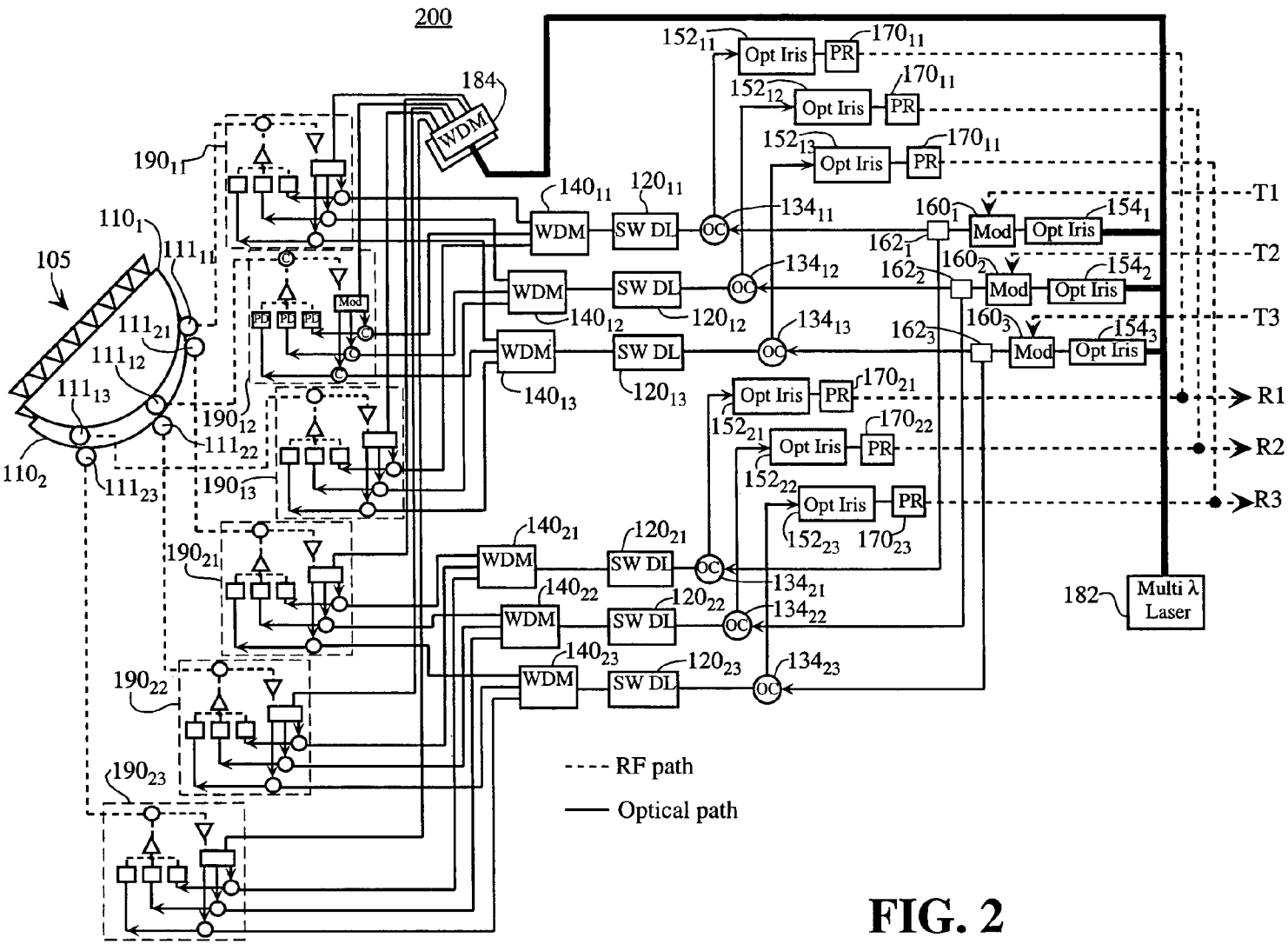
FIG. 2 shows a block diagram of the embodiment depicted in FIG. 1 with an antenna array having two RF lenses where each lens has three ports.
Figure 2A:
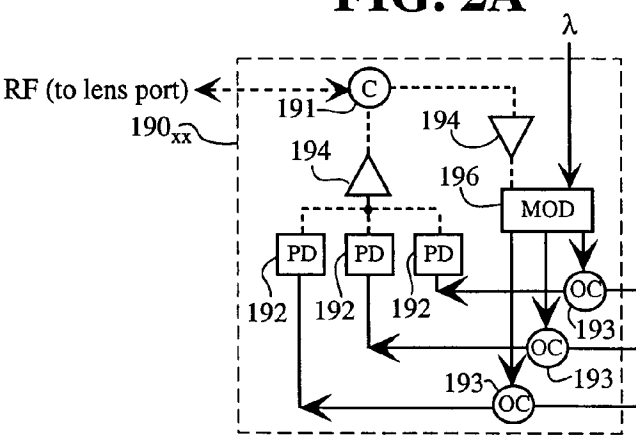
FIG. 2A shows a block diagram of an optical/electrical converter used in the embodiment depicted in FIG. 2.

To further explain the present invention, FIG. 2 shows a simplified example of an antenna system 200 according to the present invention comprising an antenna array 105 with two RF lenses $\mathbf{110}_1$, $\mathbf{110}_2$ (N=2), each lens $\mathbf{110}_1$, $\mathbf{110}_2$ having three ports (K=3) for a total of six ports $\mathbf{111}_{1\text{-}2,1\text{-}3}$. The system 200 supports three simultaneous beams (M=3). Coupled to each port $\mathbf{111}_{1\text{-}2,1\text{-}3}$ is an optical/electrical converter $\mathbf{190}_{1\text{-}2,1\text{-}3}$ to receive RF signals from the antenna array 105 and convert those signals to optical signals and to convert optical signals received from the other elements of the antenna system 200 to RF signals for radiation from the antenna array 105. FIG. 2A shows a schematic of an optical/electrical converter $\mathbf{190}_{X,X}$ in additional detail.

As shown in FIG. 2A, the optical/electrical converter $\mathbf{190}_{X,X}$ couples RF signals to and from a selected port $\mathbf{111}_{X,X}$ of the antenna array 105 and couples optical signals to and from selected WDMs $\mathbf{140}_{1\text{-}N,\ 1\text{-}M}$. An RF circulator 191 is used to couple the RF signals into and out of the converter $\mathbf{190}_{X,X}$ and optical circulators 193 are used to couple the optical signals into and out of the converter $\mathbf{190}_{X,X}$. Each optical circulator 193 couples an optical signal to a photodetector 192 for conversion to an electrical signal. The electrical signal from each photodetector 192 may be directly coupled to the RF circulator 191 for transmission by the antenna array 105 or an amplifier 194 may be used to amplify the signals before transmission. RF signals from the array 105 are directed by the RF circulator 191 to an optical modulator 196, which modulates the received RF signal onto an optical signal at a selected optical wavelength λ. Another amplifier 194 may be used to amplify the received RF signal before it is modulated by the optical modulator 196. The optical circulators 193 are then used to output RF modulated optical signals from the converter $\mathbf{190}_{X,X}$.

Returning now to FIG. 2, it can seen that since the system 200 supports three transmit and receive waveforms, there are three WDMs $\mathbf{140}_{1,\ 1\text{-}3}$ for the first RF lens $\mathbf{110}_1$ and three WDMs $\mathbf{140}_{2,\ 1\text{-}3}$ for the second RF lens $\mathbf{110}_2$. Each WDM $\mathbf{140}_{1\text{-}2,\ 1\text{-}3}$, has an associated switched delay line $\mathbf{120}_{1\text{-}2,\ 1\text{-}3}$ and optical circulator $\mathbf{134}_{1\text{-}2,\ 1\text{-}3}$. Each optical circulator $\mathbf{134}_{1\text{-}2,\ 1\text{-}3}$ outputs the RF modulated optical signal to an optical iris $\mathbf{152}_{1\text{-}1,\ 1\text{-}3}$ and photoreceiver $\mathbf{170}_{1\text{-}2,1\text{-}3}$. The photoreceivers $\mathbf{170}_{1\text{-}2,1\text{-}3}$ extract the RF signal from the optical signal. Electrically combining the RF signals from the two RF lenses $\mathbf{110}_{1\text{-}2}$ provides the three received RF waveforms R1, R2, R3. Each transmit waveform T1, T2, T3 is modulated by an electrical modulator $\mathbf{160}_{1\text{-}3}$ onto an optical signal received from an optical iris $\mathbf{154}_{1\text{-}3}$ which selects the optical wavelength or wavelengths of the optical signal. Each optical signal modulated with transmit waveform T1, T2, T3 is coupled to a 1:2 optical splitter $\mathbf{162}_{1\text{-}3}$ to direct the optical signal to both the first and second RF lenses $\mathbf{110}_{1\text{-}2}$.

Figure 3A:
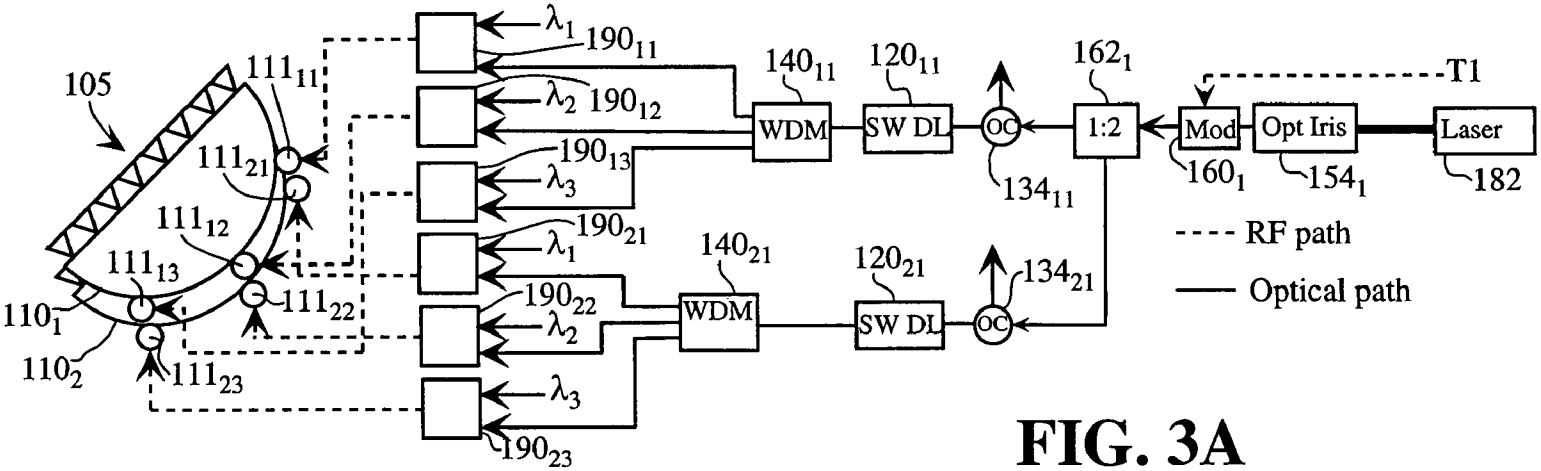
FIG. 3A shows the elements used in the transmission of a single transmit waveform in the embodiment depicted in FIG. 2.

FIG. 3A shows the specific elements involved with the transmission of a single transmit waveform T1 in the system 200 depicted in FIG. 2. The optical iris $\mathbf{154}_1$ receives a multiple wavelength optical signal from the multiple wavelength laser source 182 and selects a single optical wavelength or group of wavelengths onto which the transmit waveform T1 will be modulated by the optical modulator $\mathbf{160}_1$. The optical signal modulated with the transmit waveform is then split by a 1:2 optical splitter $\mathbf{162}_1$ into two branches for eventual presentation to the two RF lenses $\mathbf{110}_1$, $\mathbf{110}_2$.

The transmit optical signal is then coupled into switched delay lines $\mathbf{120}_{11}$, $\mathbf{120}_{21}$ by optical circulators $\mathbf{134}_{11}$, $\mathbf{134}_{21}$ in each branch. The switched delay lines $\mathbf{120}_{11}$, $\mathbf{120}_{21}$ provide for elevation control over the transmitted beam, where azimuth control over the beams is provided by selection of the ports of the RF lenses $\mathbf{110}_1$, $\mathbf{110}_2$, discussed in additional detail below. The outputs of the switched delay lines $\mathbf{120}_{11}$, $\mathbf{120}_{21}$ in each branch are then coupled to WDMs $\mathbf{140}_{11}$, $\mathbf{140}_{21}$ which provide optical outputs at selected optical wavelengths. The optical outputs from the WDMs $\mathbf{140}_{11}$, $\mathbf{140}_{21}$ are then coupled to the optical/electric converters $\mathbf{190}_{1\text{-}2,1\text{-}3}$ for conversion back to RF signals.

From FIG. 3A, it can be seen that the combination of the optical irises $\mathbf{154}_1$, $\mathbf{154}_2$, WDMs $\mathbf{140}_{11}$, $\mathbf{140}_{21}$ and the optical/electric converters $\mathbf{190}_{1\text{-}2,1\text{-}3}$ provides for the direction of the transmit waveform to selected ports on the RF array. For example, if the optical irises $\mathbf{154}_1$, $\mathbf{154}_2$ are configured to have the transmit waveform T1 modulated onto an optical signal at wavelength $\lambda_1$, the WDMs $\mathbf{140}_{11}$, $\mathbf{140}_{21}$ will cause the transmit optical signal to be directed to the optical/electric converters $\mathbf{190}_{11}$, $\mathbf{190}_{21}$ coupled to the first ports $\mathbf{111}_{11}$, $\mathbf{111}_{21}$ of the RF lenses $\mathbf{110}_1$, $\mathbf{110}_2$. Provision of an optical signal at the same wavelength $\lambda_1$ to the optical/electric converters $\mathbf{190}_{11}$, $\mathbf{190}_{21}$ allows the transmit waveform T1 to be recovered from the transmit optical signal and then radiated by the RF array 105.

Figure 3B:
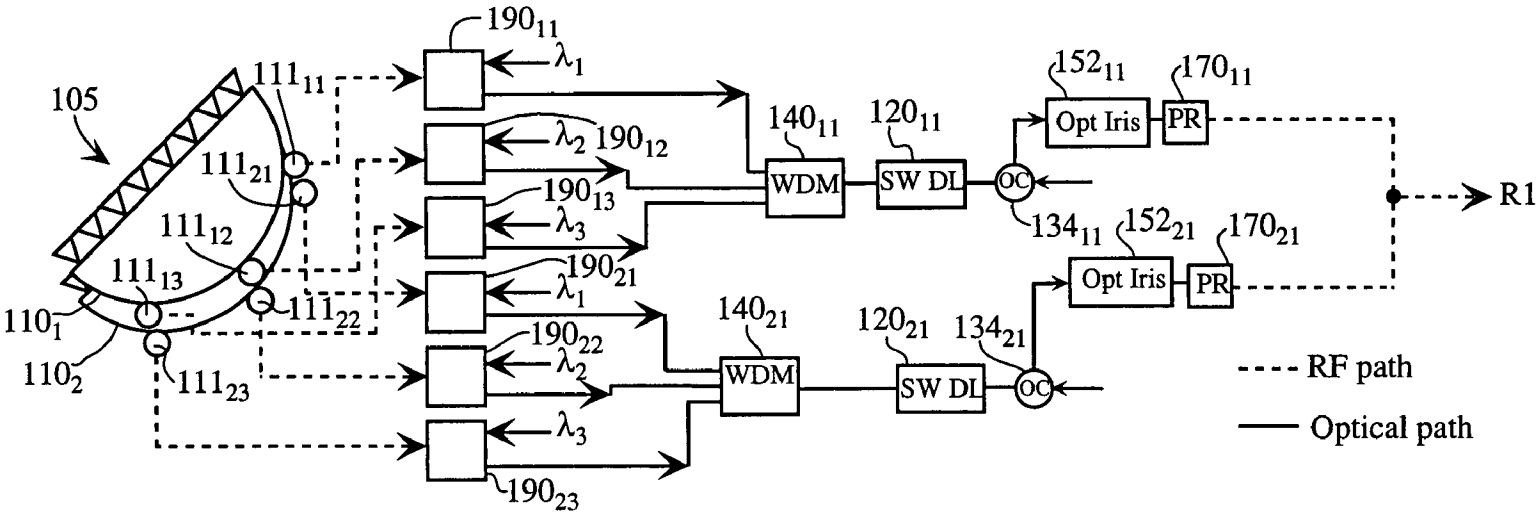
FIG. 3B shows the elements used for the reception of a single receive waveform in the embodiment depicted in FIG. 2.

FIG. 3B shows the specific elements involved with the reception of a single receive waveform R1 in the system 200 depicted in FIG. 2. For the reception of a signal from a particular azimuth direction, the optical irises $\mathbf{152}_{11}$, $\mathbf{152}_{21}$ provide for the selection of a specific port $\mathbf{111}_{1\text{-}2,1\text{-}3}$ or set of ports $\mathbf{111}_{1\text{-}2,1\text{-}3}$ that enable the reception of a signal at a specified azimuth angle.

In FIG. 3B, the ports $\mathbf{111}_{1\text{-}2,1\text{-}3}$ are coupled to specific antenna elements such that each port $\mathbf{111}_{1\text{-}2,1\text{-}3}$ of the RF lenses $\mathbf{110}_1$, $\mathbf{110}_2$ may provide a different receive antenna beam pattern, especially in the azimuth direction. The ports $\mathbf{111}_{1\text{-}2,1\text{-}3}$ couple RF signals from the RF lenses $\mathbf{110}_1$, $\mathbf{110}_2$ to the optical/electrical converters $\mathbf{190}_{1\text{-}2,1\text{-}3}$, where the RF signals are converted to optical signals at wavelengths $\lambda_1$, $\lambda_2$, $\lambda_3$. The WDMs $\mathbf{140}_{11}$, $\mathbf{140}_{21}$ receive the multiple optical signals and combine them into a single composite optical signal. The switched delay lines $\mathbf{120}_{11}$, $\mathbf{120}_{21}$ delay the composite optical signals in relation to each other to provide elevational beam shaping. The composite optical signals are then directed by optical circulators $\mathbf{134}_{11}$, $\mathbf{134}_{21}$ to optical irises $\mathbf{170}_{11}$, $\mathbf{170}_{21}$. The optical irises are then configured to select optical signals at a specified wavelength or range of wavelengths. The filtered optical signals are then coupled to photoreceivers $\mathbf{170}_{11}$, $\mathbf{170}_{21}$ which convert the optical signals back to electrical signals at the RF wavelength of the original received RF signal. The electrical signals from the two photoreceivers $\mathbf{170}_{11}$, $\mathbf{170}_{21}$ are combined to provide the received signal R1.

From FIG. 3B, it can be seen that, for example, if the optical irises $\mathbf{152}_{11}$, $\mathbf{152}_{21}$ are configured to pass optical signals only at optical wavelength $\lambda_1$, ports $\mathbf{111}_{11}$, $\mathbf{111}_{21}$ are essentially selected. Therefore, the receive signal R1 will have a beam shape determined by the coupling of signals by the RF lenses $\mathbf{110}_1$, $\mathbf{110}_2$ to the ports $\mathbf{111}_{11}$, $\mathbf{111}_{21}$. However, the optical irises $\mathbf{152}_{11}$, $\mathbf{152}_{21}$ may also be configured to pass optical signals in the range of frequencies defined by $\lambda_1$, $\lambda_2$, and $\lambda_3$. In such a configuration, the receive signal R1 will have a beam pattern determined by all ports $\mathbf{111}_{1\text{-}2,\ 1\text{-}3}$.

Figure 4:
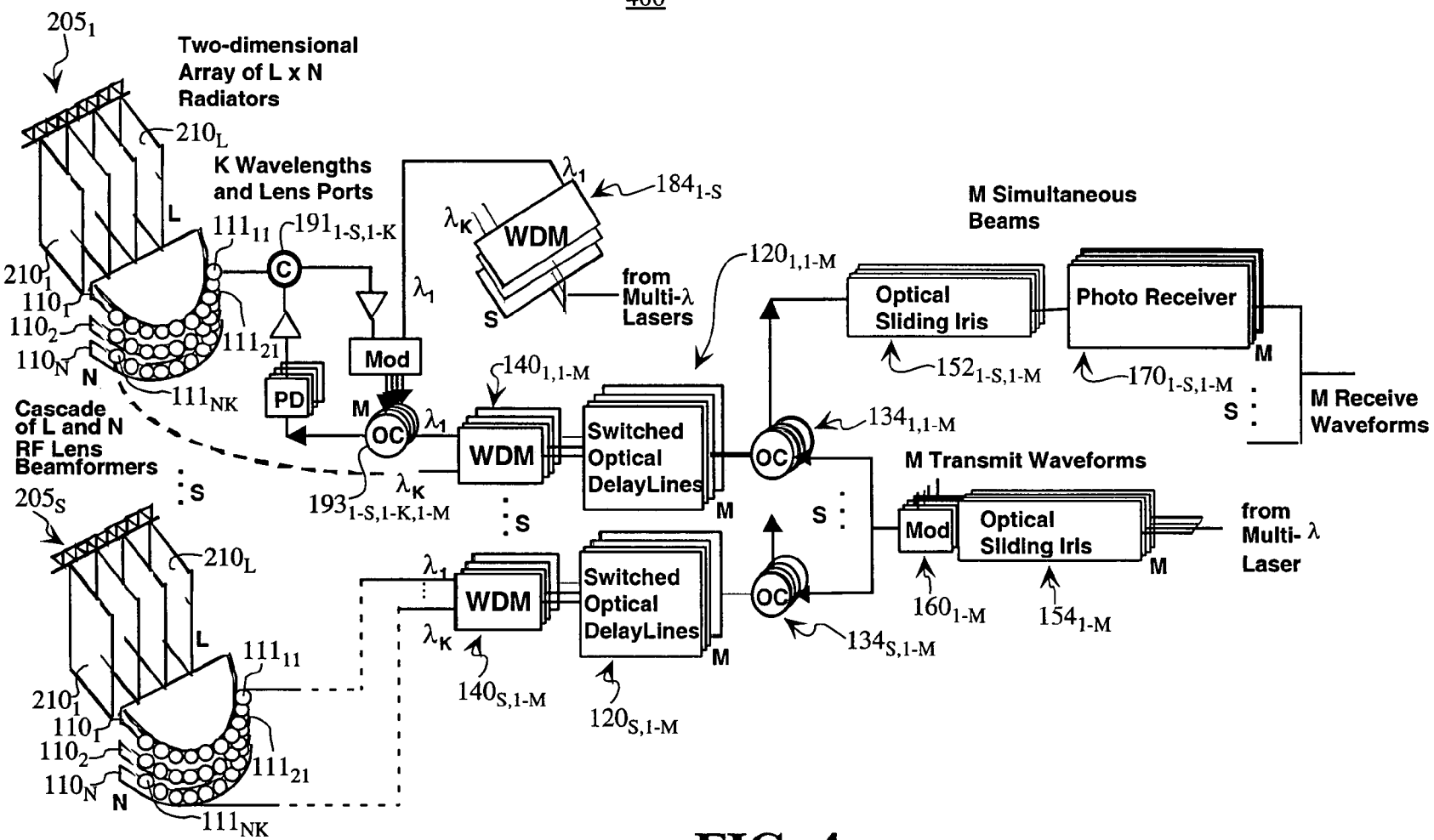
FIG. 4 shows a block diagram of an alternative embodiment of a beam forming system according to the present invention.

FIG. 4 illustrates another embodiment of a beamformer system 400 according to the present invention that arranges the antenna elements into radiator sub-arrays $\mathbf{205}_{1\text{-}S}$ where each radiator in the radiator sub-array $\mathbf{205}_{1\text{-}S}$ is controlled by a cascade of two sets of RF lenses $\mathbf{110}_{1\text{-}N}$, $\mathbf{210}_{1\text{-}L}$ in each antenna sub-array $\mathbf{205}_{1\text{-}S}$. Such a cascade of RF lenses is a well-known construction. In the system 400 depicted in FIG. 4, each sub-array $\mathbf{205}_{1\text{-}S}$ has L×N radiators and, therefore, up to L×N ports. As with the system 100 described above, the system 400 in FIG. 4 has a different optical wavelength associated with each of the lens ports. Since there may be up to L×N ports, the number of distinct wavelengths K required may also be equal to L×N. Therefore, in the system 400 depicted in FIG. 4, each distinct wavelength selects a specific port $\mathbf{111}_{1\text{-}S,1\text{-}K}$ that may be coupled to a specific radiator in a specific sub-array $\mathbf{205}_{1\text{-}S}$.

The beam-angle ports $\mathbf{111}_{1\text{-}S,1\text{-}K}$ of the cascade define the beam position in both axes (e.g., both azimuth and elevation). The various sub-arrays $\mathbf{205}_{1\text{-}S}$ of RF lenses can be given the proper phases by applying appropriate time-delays to the RF signals for the sub-arrays $\mathbf{205}_{1\text{-}S}$. The optical irises $\mathbf{152}_{1\text{-}S,\ 1\text{-}M}$, $\mathbf{154}_{1\text{-}M}$ can select a single port or a group of ports. In one configuration, the radiator sub-arrays $\mathbf{205}_{1\text{-}S}$ connected to the lens cascade comprise the entire antenna array. Thus, in this first configuration, each lens port $\mathbf{111}_{1\text{-}S,\ 1\text{-}K}$ may define the beam position determined by the entire array antenna. A wider antenna beam can be defined by accessing multiple adjacent lens ports $\mathbf{111}_{1\text{-}S,\ 1\text{-}K}$. In a second configuration, each radiator sub-array $\mathbf{205}_{1\text{-}S}$ comprises a sub-array of an entire antenna array. Thus, in this second configuration, each port $\mathbf{111}_{1\text{-}S,1\text{-}K}$ of a lens cascade (i.e., of each radiator sub-array $205_{1\text{-}S}$) produces a coarse determination of the beam angle (i.e., the sub-array beam pattern). The time delays for the different sub-arrays $205_{1\text{-}S}$ may then define the fine beam angle. In this latter configuration, accessing of multiple cascaded-lens ports with the optical iris $152_{1\text{-}S,\ 1\text{-}M}$, $154_{1\text{-}M}$ results in the accessing of multiple fine beams by the same exciter or receiver.

The RF lenses $110_{1\text{-}N}$, $210_{1\text{-}L}$ of the two embodiments described above and depicted in FIGS. 1 and 4 could be implemented by multi-wavelength optical Rotman lenses such as the ones disclosed in U.S. Pat. No. 6,348,890 or U.S. Pat. No. 6,452,546. With multi-wavelength optical Rotman lenses, each lens port would be associated with a different set of closely spaced optical wavelengths. The WDMs $140_{1\text{-}N,\ 1\text{-}M}$, $184_{1\text{-}N}$ shown in FIG. 1 or the WDMs $140_{1\text{-}S,\ 1\text{-}M}$, $184_{1\text{-}S}$ shown in FIG. 4 would multiplex and demultiplex these wavelength sets. The optical irises $152_{1\text{-}N,\ 1\text{-}M}$, $152_{1\text{-}S,1\text{-}M}$, $154_{1\text{-}M}$ would select one or more of these wavelength sets. As an example, each lens port $111_{1\text{-}N,1\text{-}K}$, $111_{1\text{-}S,1\text{-}K}$, could have a set of 8 wavelengths with a spacing of 12.5 GHz and could handle RF signals of bandwidth greater than 3 GHz. The WDMs $140_{1\text{-}N,\ 1\text{-}M}$, $140_{1\text{-}S,\ 1\text{-}M}$ could then have wavelength spacings of 200 GHz, to allow for the filter shape of the WDM $140_{1\text{-}N,\ 1\text{-}M}$, $140_{1\text{-}S,\ 1\text{-}M}$ (e.g., a Gaussian function). At least 20 or more lens ports could be accessed in this manner.

Figure 5A:
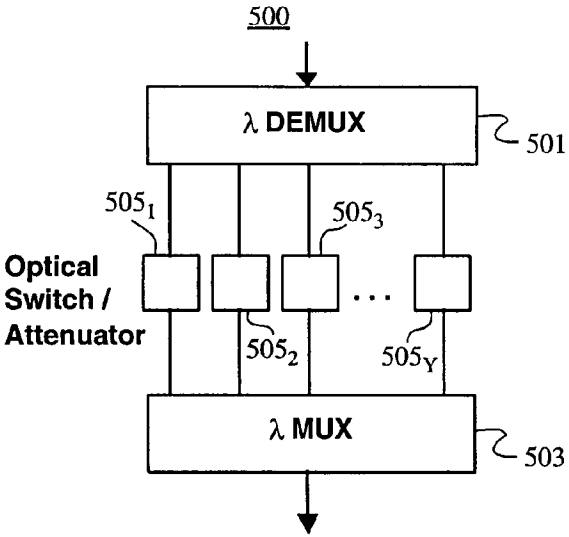
FIG. 5A shows a block diagram of an embodiment of an optical iris according to the present invention.
Figure 5B:
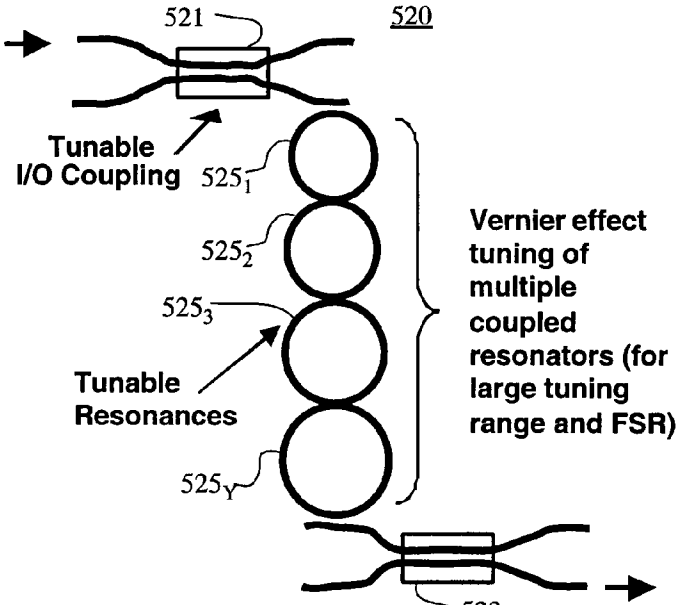
FIG. 5B shows a block diagram of an alternative embodiment of an optical iris according to the present invention.

The optical irises $152_{1\text{-}N,\ 1\text{-}M}$, $152_{1\text{-}S,1\text{-}M}$, $154_{1\text{-}M}$ according to embodiments of the present invention are preferably agile optical filters whose center wavelengths and bandwidths can be adjusted. Two possible implementations of the optical iris are shown in FIGS. 5A and 5B. FIG. 5A shows an optical iris 500 using optical-wavelength demultiplexers 501 and multiplexers 503. AWGs could be used for these components. A set of optical switch/attenuators $505_{1\text{-}Y}$ are disposed between the demultiplexers 501 and multiplexers 503 to select the particular wavelengths that are passed by the iris 500. By using the attenuators $505_{1\text{-}Y}$, the relative amplitudes of those wavelengths can be adjusted. In this way, different lens ports can be accessed and be given different weights, for shaping of the beam. Note that the wavelengths (and lens ports) selected by this type of iris 500 need not be contiguous or adjacent to each other.

Another optical iris 520 according to an embodiment of the present invention is shown in FIG. 5B. This optical iris 520 is an optical filter constructed from multiple, coupled optical resonators $525_{1\text{-}Y}$. An input coupler 521 is used to couple an optical signal to the resonators $523_{1\text{-}Y}$ and an output coupler 523 is used to couple a filtered optical signal from the resonators. Four resonators $525_{1\text{-}Y}$ are shown in FIG. 5B as an example, but those skilled in the art understand that fewer than or more than four resonators $525_{1\text{-}Y}$ may be used. Each resonator $525_{1\text{-}Y}$ preferably has a different size and thus different free spectral range (FSR). The FSR of the combination of coupled resonators $525_{1\text{-}Y}$ can be much larger than the FSR associated with any resonator $525_{1\text{-}Y}$. The use of multiple coupled resonators to achieve larger FSR is described by Oda, et al., in J. Lightwave Technology, vol. 9, no. 6, pp. 728–736 (1991).

Tuning of the coupled resonators $525_{1\text{-}Y}$ is accomplished by the Vernier effect, which is known. This tuning changes the center wavelength of the optical iris 520. The optical refractive index in each resonator $525_{1\text{-}Y}$ (which determines the effective size of the resonator) can be changed by various known means such as application of a voltage to electro-optic material or injection of current (free carriers). The bandwidth of the optical iris 520 can be tuned by adjusting the strength of coupling between the resonators $525_{1\text{-}Y}$ and the input/output couplers 521, 523. This changes the external (loaded) Q of the iris 520. The optical iris 520 can be fabricated in an electro-optic material such as lithium niobate or gallium arsenide or indium phosphide. The optical refractive index in the resonators $525_{\text{-}Y}$ and the coupling strengths to the input/output couplers 521, 523 can be changed by fabricating electrodes in those regions and applying control voltages. Note that because the FSR is that of the coupled resonators $525_{1\text{-}Y}$, the FSR of each resonator $525_{1\text{-}Y}$ can be much smaller. Thus, the diameter of each circular resonator $525_{1\text{-}Y}$ can be larger, to reduce the optical propagation loss.

The switched optical delay lines $120_{1\text{-}N,1\text{-}M}$, $120_{1\text{-}S,1\text{-}M}$ depicted in FIGS. 1 and 4 may be implemented in many ways. One possible implementation uses the monolithic delay lines and switches that are described in U.S. Pat. No. 5,222,162, which is incorporated herein by reference. Another example is the Merged Dual Flipped White Cell described in U.S. application Ser. No. 10/696,607, filed Oct. 28, 2003, and incorporated herein by reference. However, those skilled in the art will understand that no particular implementation of the switched optical delay lines is required as long as the switching function provided by the switched optical delay lines $120_{1\text{-}N,1\text{-}M}$, $120_{1\text{-}S,1\text{-}M}$ routes the light through the desired time-delay path. Further, alternative embodiments of the present invention may incorporate the optical-wavelength selection and optical iris aspects of the systems described herein without the use of the switched optical delay lines described above.

Systems according to embodiments of the present invention may also incorporate optical wavelength selected optical time delays. Optical wavelength selected time delays are described by H. Zmuda, et al. in IEEE Photonics Technology Letters, vol. 9, no. 2, pp. 241–244 (1997). The time delays are selected by sets of Bragg gratings and delay line segments formed in optical fibers. These sets of fiber Bragg gratings and delay line segments, which may be constructed as a fiber grating prism (FGP), would be used in place of the RF lenses used in the embodiments of the present invention described above. The fiber Bragg gratings and delay line segments may replace the RF lenses by providing the time delays for the different antenna radiators.

Figure 6A:
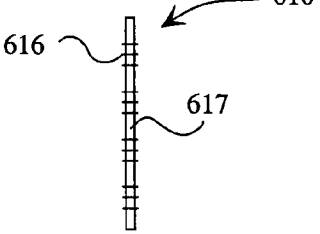
FIG. 6A shows a schematic representation of a wavelength selective delay structure comprising fiber Bragg gratings and delay line structures.
Figure 6:
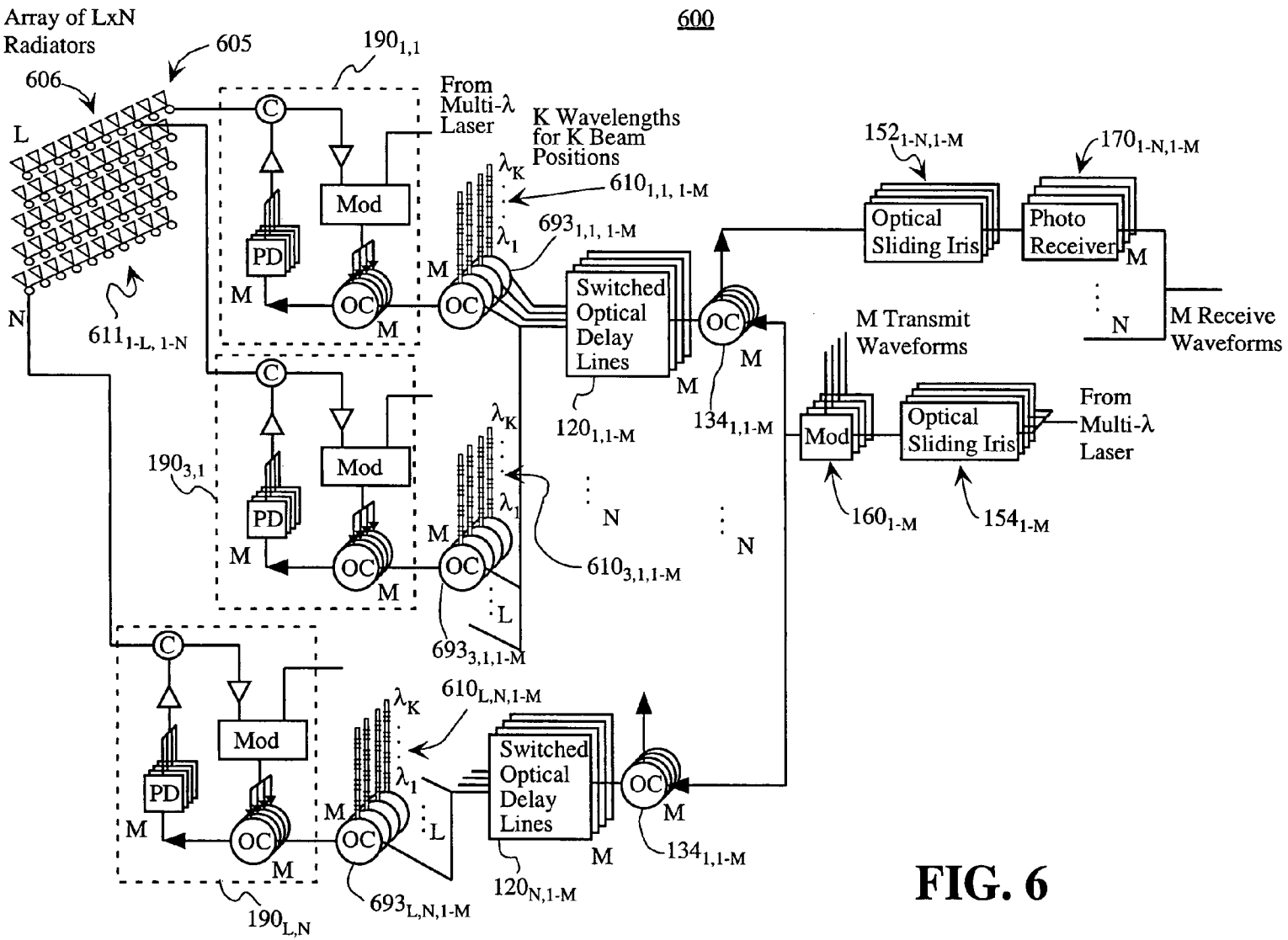
FIG. 6 shows a block diagram of another embodiment of a beam forming system according to the present invention which uses fiber Bragg gratings.

A system 600 according to an embodiment of the present invention in which fiber Bragg gratings are used is depicted in FIG. 6. The system 600 depicted in FIG. 6 is similar to the systems shown in FIG. 1 and FIG. 4, except that wavelength selective delay structures $610_{1\text{-}L,1\text{-}N,1\text{-}M}$ are used in place of the RF lenses $110_{1\text{-}N}$, $210_{1\text{-}L}$ and WDMs $140_{1\text{-}N,1\text{-}M}$, $140_{1\text{-}S,1\text{-}M}$ shown in FIGS. 1 and 4. As shown in FIG. 6, an array 605 of L×N radiators 606 is used to transmit and receive signals. The radiators 606 may be coupled to beam ports $611_{1\text{-}L,1\text{-}N}$ in a one-to-one correspondence, that is, each radiator 606 may have a corresponding beam port $611_{1\text{-}L,1\text{-}N}$, or each beam port $611_{1\text{-}L,1\text{-}N}$ may be coupled to a plurality of radiators. However, as described above, each beam port $611_{1\text{-}L,1\text{-}N}$ corresponds to an antenna beam produced by the radiators 606 coupled to the beam port $611_{1\text{-}L,1\text{-}N}$.

The wavelength selective delay structures $610_{1\text{-}L,1\text{-}N,1\text{-}M}$ comprise fiber Bragg gratings disposed in delay segments such that optical signals at different optical wavelengths will reflect from different Bragg gratings depending on the optical wavelength, thus providing that the optical signals will acquire different delays depending on their optical wavelength. FIG. 6A shows a schematic of a wavelength selective structure 610 having fiber Bragg gratings 616 with optical delay line segments 617 positioned either between the fiber Bragg gratings 616 or prior to the fiber Bragg gratings 616.

In the system 600 depicted in FIG. 6, each optical wavelength is associated with a particular beam angle. The optical circulators $\mathbf{693}_{1\text{-}L,1\text{-}N,1\text{-}M}$ serve to route optical signals to the wavelength selective delay structures $\mathbf{610}_{1\text{-}L,1\text{-}N,1\text{-}M}$ to apply a delay dependent on the optical wavelength to each optical transmit or receive signal. The optical/electrical converters $\mathbf{190}_{1\text{-}L,1\text{-}N}$ and the optional switched delay lines $\mathbf{120}_{1\text{-}N,1\text{-}M}$ operate in a similar fashion as that described above for the embodiments depicted in FIGS. 1 and 4. Finally, the optical irises $\mathbf{152}_{1\text{-}N,\ 1\text{-}M}$, $\mathbf{154}_{1\text{-}M}$ select the number of beam angles that are accessed by an exciter or receiver. As described in Zmuda, et al., the fiber Bragg gratings and delay line segments (i.e., the wavelength selective delay structures) may be provided by a Fiber Grating Prism (FGP). The method described in U.S. Pat. No. 6,452,546 for grouping sets of optical wavelengths may be used to group sets associated with particular antenna elements to reduce optical-combining losses for multiple simultaneous beams. Otherwise each beam should have its own FGP.

Having described the invention in connection with embodiments presented above, modification will now certainly suggest itself to those skilled in the art. For example, while the embodiments present above use some components operating at optical frequencies, those skilled in the art will understand that these optical components may be replaced with components operating at lower frequencies. As such, the invention is not to be limited to the disclosed embodiments except as required by the appended claims.

What is claimed is:

1. An antenna beam forming apparatus comprising:

a plurality of antenna beam ports;

one or more irises, each iris comprising a filter with at least one selectable center frequency and at least one selectable passband width; and a distribution network coupling the plurality of antenna beam ports to the one or more irises, wherein at least one center frequency and at least one passband width of at least one iris are selected to select one or more antenna beam ports.

2. The antenna beam forming apparatus according to claim 1, wherein the one or more irises comprise one or more optical irises and the distribution network comprises a plurality of optical/electrical converters, at least one optical/electrical converter receiving a received electrical signal from at least one antenna beam port and converting the electrical signal to a receive waveform optical signal and/or at least one optical/electrical converter receiving a transmit waveform optical signal and converting the transmit waveform optical signal to a transmitted electrical signal and directing the transmitted electrical signal to one or more antenna beam ports.

3. The antenna beam forming apparatus according to claim 2, wherein the distribution network further comprises one or more switched optical delay lines coupling the one or more optical irises to the plurality of optical/electrical converters.

4. The antenna beam forming apparatus according to claim 2, wherein the plurality of optical/electrical converters receive a plurality of optical carriers at different optical frequencies and wherein the at least one optical/electrical converter modulates at least one optical carrier with the received electrical signal and the antenna beam forming apparatus further comprises one or more photo receivers coupled to the one or more irises.

5. The antenna beam forming apparatus according to claim 2, wherein the one or more irises receive one or more optical carriers and the antenna beam forming apparatus further comprises one or more optical modulators, each optical modulator having a first input coupled to one iris and having a second input receiving an electrical transmit waveform and having an output coupled to one or more antenna beam ports.

6. The antenna beam forming apparatus according to claim 2, wherein the one or more optical irises comprise one or more transmit irises and one or more receive irises, the one or more transmit irises receiving one or more optical carriers, and wherein the plurality of optical/electrical converters receive a plurality of optical carriers at different optical frequencies and wherein the at least one optical/electrical converter modulates at least one optical carrier with the received electrical signal and the antenna beam forming apparatus further comprises:

one or more photo receivers coupled to the one or more receive irises;

one or more optical modulators, each optical modulator having a first input coupled to one transmit iris and having a second input receiving an electrical transmit waveform; and one or more optical circulators, each optical circulator having a first port coupled to one or more antenna beam ports, a second port coupled to at least one receive iris, and a third port coupled to at least one optical modulator.

7. The antenna beam forming apparatus according to claim 1, wherein the distribution network comprises:

one or more optical wavelength division multiplexers coupling the one or more irises to the plurality of antenna beam ports.

8. The antenna beam forming apparatus according to claim 7, wherein the antenna beam forming apparatus further comprises:

a plurality of antenna radiators; and one or more radio frequency lenses coupling the plurality of antenna beam ports to the plurality of antenna radiators.

9. The antenna beam forming apparatus according to claim 7, wherein the antenna beam forming apparatus further comprises:

a plurality of antenna radiators; and a cascade of two or more sets of radio frequency lenses coupling the plurality of antenna beam ports to the plurality of antenna radiators.

10. The antenna beam forming apparatus according to claim 2, wherein the antenna beam forming apparatus further comprises:

an array of antenna radiators coupled to the plurality of antenna beam ports, and wherein the distribution network further comprises:

one or more wavelength selective delay structures; and one or more optical circulators, each optical circulator having a first port coupled to at least one switched optical delay line, a second port coupled to at least one optical/electrical converter, and a third port coupled to at least one wavelength selective delay structure of the one or more wavelength selective delay structures.

11. The antenna beam forming apparatus according to claim 10, wherein at least one wavelength selective delay structure comprises a plurality of fiber Bragg gratings separated by and/or preceded by one or more optical delay line segments.

12. The antenna beam forming apparatus according to claim 11, wherein the at least one wavelength selective delay structure is provided by one or more fiber grating prisms.

13. The antenna beam forming apparatus according to claim 2, wherein at least one optical iris comprises:

an optical demultiplexer;

an optical multiplexer; and one or more optical switch/attenuators coupled to the optical demultiplexer and the optical multiplexer.

14. The antenna beam forming apparatus according to claim 2, wherein at least one optical iris comprises:

an input coupler;

an output coupler; and one or more tunable optical resonators disposed in series between the input coupler and the output coupler.

15. A method for selecting a composite antenna beam for received signals comprising:

receiving one or more received signals;

modulating at least one received signal with multiple optical carrier signals to produce multiple modulated optical signals, each carrier signal having a different center frequency; and filtering the multiple modulated optical signals at a selected center frequency and passband width to select a specific one or ones of the multiple modulated optical signals.

16. The method according to claim 15, wherein a delay is applied to at least one modulated signal of the multiple modulated optical signals and wherein the amount of applied delay is based on a selected antenna beam pattern.

17. The method according to claim 15, wherein the one or more received signals are received at a plurality of antenna beam ports.

18. The method according to claim 16, wherein the method further comprises:

converting the one or more received signals to one or more received optical signals; and converting the one or more delayed signals to one or more electrical receive signals.

19. The method according to claim 17, wherein the method further comprises:

receiving one or more radio frequency signals at one or more radiators;

directing the one or more radio frequency signals through one or more radio frequency lenses; and directing the one or more radio frequency signals to the plurality of antenna beam ports to produce the one or more received signals.

20. The method according to claim 17, wherein the method further comprises:

receiving one or more radio frequency signals at one or more radiators;

directing the one or more radio frequency signals through a cascade of two or more sets of radio frequency lenses; and directing the one or more radio frequency signals to the plurality of antenna beam ports to produce the one or more received signals.

21. The method according to claim 17, wherein the method further comprises:

receiving one or more radio frequency signals at one or more radiators;

directing the one or more radio frequency signals to the plurality of antenna beam ports to produce the one or more received signals; and delaying the one or more modulated signals based on a center frequency of each one of the one or more modulated signals before applying delays to the one or more modulated signals to create one or more delayed signals.

22. The method according to claim 21, wherein delaying the one or more modulated signals comprises directing the one or more modulated signals into fiber gratings disposed in delay segments.

23. A method for forming a composite antenna beam for transmitted signals comprising:

generating multiple optical carrier signals, each optical carrier signal having a different center frequency;

filtering the multiple optical carrier signals at a selected center frequency and passband width to select a specific one or ones of the multiple optical carrier signals;

modulating the selected carrier signals with one or more transmit waveforms to create one or more modulated carrier signals.

24. The method according to claim 23, wherein a delay is applied to at least one of the one or more modulated carrier signals, and wherein the amount of applied delay is based on a selected antenna beam pattern.

25. The method according to claim 23, wherein the method further comprises directing the one or more modulated carrier signals to one or more antenna beam ports.

26. The method according to claim 25, wherein directing the one or more modulated carrier signals to one or more antenna beam ports comprises:

directing the one or more modulated carrier signals to selected optical-to-electrical converters based on a center optical frequency of each one of the one or more modulated carrier signals; and converting each one of the one or more modulated carrier signals to a corresponding electrical signal with the selected optical-to-electrical converters.

27. The method according to claim 26, wherein the method further comprises coupling radio frequency signals from the one or more antenna beam ports to antenna radiators with one or more radio frequency lenses.

28. The method according to claim 26, wherein the method further comprises coupling radio frequency signals from the one or more antenna beam ports to antenna radiators with a cascade of two or more sets of radio frequency lenses.

29. The method according to claim 26, wherein the one or more carrier signals comprise optical carrier signals and directing the one or more modulated carrier signals to one or more antenna beam ports comprises:

delaying the one or more modulated carrier signals based on a center optical frequency of each one of the one or more modulated carrier signals to produce one or more wavelength dependent delayed signals; and converting each one of the one or more wavelength dependent delayed signals to corresponding electrical signals.

30. The method according to claim 29, wherein delaying the one or more modulated carrier signals comprises directing the one or more modulated carrier signals into fiber gratings disposed in delay segments.

31. An antenna beam forming apparatus comprising:

a plurality of antenna beam ports;

means for bandpass filtering signals; and means for coupling the plurality of antenna beam ports to the means for bandpass filtering signals, wherein the means for bandpass filtering signals is controlled to select one or more antenna beam ports.

32. The antenna beam forming apparatus according to claim 31, wherein the means for bandpass filtering signals filters optical signals and the means for coupling comprises:

means for converting electrical signals to optical signals, the means for converting electrical signals to optical signals receiving a received electrical signal from at least one antenna beam port and converting the electrical signal to a receive waveform optical signal; and/or means for converting optical signals to electrical signals, the means for converting optical signals to electrical signals receiving a transmit waveform optical signal and converting the transmit waveform optical signal to a transmitted electrical signal and directing the transmitted electrical signal to one or more antenna beam ports.

33. The antenna beam forming apparatus according to claim 32, wherein the means for coupling further comprises means for providing switched optical delays coupled to the means for bandpass filtering signals.

34. The antenna beam forming apparatus according to claim 33, wherein the means for converting electrical signals to optical signals receives a plurality of optical carriers at different optical frequencies and wherein the means for converting electrical signals to optical signals modulates at least one optical carrier with the received electrical signal and the antenna beam forming apparatus further comprises means for photodetection coupled to the means for filtering signals.

35. The antenna beam forming apparatus according to claim 33, wherein the means for bandpass filtering signals receives one or more optical carriers and the antenna beam forming apparatus further comprises means for optical modulation, the means for optical modulation disposed between the means for bandpass filtering signals and the means for providing switched optical delays and receiving one or more electrical transmit waveforms.

36. The antenna beam forming apparatus according to claim 33, wherein the means for coupling further comprises:

means for multiplexing optical signals, the means for multiplexing optical signals coupling the means for providing switched optical delays to the means for converting electrical signals to optical signals and/or to the means for converting optical signals to electrical signals.

37. The antenna beam forming apparatus according to claim 36, wherein the antenna beam forming apparatus further comprises:

means for radiating and/or receiving electromagnetic energy; and means for coupling electromagnetic energy between the means for radiating and/or receiving electromagnetic energy and the plurality of antenna beam ports.

38. The antenna beam forming apparatus according to claim 33, wherein the antenna beam forming apparatus comprises:

an array of antenna radiators coupled to the plurality of antenna beam ports, and wherein the means for coupling further comprises:

means for providing wavelength selective delays disposed between the means for providing switched optical delays and the means for converting electrical signals to optical signals and/or the means for converting optical signals to electrical signals.

39. The antenna beam forming apparatus according to claim 31, wherein the means for bandpass filtering signals comprises:

means for demultiplexing an optical signal;

means for multiplexing an optical signal; and means for attenuating and/or switching an optical signal, the means for attenuating and/or switching an optical signal disposed between the means for demultiplexing an optical signal and the means for multiplexing an optical signal.

40. The antenna beam forming apparatus according to claim 31, wherein the means for bandpass filtering signals comprises:

means for providing resonance of an optical signal;

means for coupling a signal into and out of the means for providing a resonance; and means for adjusting the strength of coupling of a signal into and out of the means for providing a resonance.

41. An apparatus comprising:

an array of antenna radiators;

one or more planar radio frequency lenses coupling a plurality of antenna beam ports to the array of antenna radiators;

a plurality of optical/electrical converters, wherein each optical/electrical converter is coupled to a corresponding antenna beam port;

one or more carrier signal wavelength division multiplexers/demultiplexers, wherein the carrier signal wavelength division multiplexers/demultiplexers provide carrier signals at different optical wavelengths to the plurality of optical/electrical converters;

a plurality of optical wavelength division multiplexers/demultiplexers coupled to the plurality of optical/electrical converters;

one or more receive signal optical sliding irises coupled to the plurality of optical wavelength division multiplexers/demultiplexers;

one or more photoreceivers coupled to the one or more receive signal optical sliding irises;

one or more transmit signal optical sliding irises; and one or more optical modulators modulating one or more transmit waveforms on transmit carriers from the one or more transmit signal optical sliding irises and outputting one or more modulated outputs to the plurality of switched optical delay lines.

42. The apparatus according to claim 41 further comprising a plurality of switched optical delay lines coupling the plurality of optical wavelength division multiplexers/demultiplexers to the one or more receive signal optical sliding irises.

43. An apparatus comprising:

a two-dimensional array of antenna radiators;

a cascade of two or more planar radio frequency lenses coupling a plurality of antenna beam ports to the array of antenna radiators;

a plurality of optical/electrical converters, wherein each optical/electrical converter is coupled to a corresponding antenna beam port;

one or more carrier signal wavelength division multiplexers/demultiplexers, wherein the carrier signal wavelength division multiplexers/demultiplexers provide carrier signals at different optical wavelengths to the plurality of optical/electrical converters;

a plurality of optical wavelength division multiplexers/demultiplexers coupled to the plurality of optical/electrical converters;

one or more receive signal optical sliding irises coupled to the plurality of optical wavelength division multiplexers/demultiplexers;

one or more photoreceivers coupled to the one or more receive signal optical sliding irises;

one or more transmit signal optical sliding irises; and one or more optical modulators modulating one or more transmit waveforms on transmit carriers from the one or more transmit signal optical sliding irises and outputting one or more modulated outputs to the plurality of switched optical delay lines.

44. The apparatus according to claim 43 further comprising a plurality of switched optical delay lines coupling the plurality of optical wavelength division multiplexers/demultiplexers to the one or more receive signal optical sliding irises.

45. An apparatus comprising:

an array of antenna radiators having a plurality of antenna beam ports coupling signals to the antenna radiators in the array of antenna radiators;

a plurality of optical/electrical converters, wherein each optical/electrical converter is coupled to a corresponding antenna beam port;

one or more carrier signal wavelength division multiplexers/demultiplexers, wherein the carrier signal wavelength division multiplexers/demultiplexers provide carrier signals at different optical wavelengths to the plurality of optical/electrical converters;

a plurality of wavelength selective delay structures;

one or more receive signal optical sliding irises coupled to the plurality of wavelength selective delay structures;

one or more photoreceivers coupled to the one or more receive signal optical sliding irises;

one or more transmit signal optical sliding irises; and one or more optical modulators modulating one or more transmit waveforms on transmit carriers from the one or more transmit signal optical sliding irises and outputting one or more modulated outputs to the plurality of switched optical delay lines.

46. The apparatus according to claim 45 further comprising a plurality of switched optical delay lines coupling the plurality of wavelength selective delay structures to the one or more receive signal optical sliding irises.

47. The method according to claim 23 wherein the selected center frequency coincides with a one of said different center frequencies.

48. The method according to claim 23 wherein the selected center frequency does not coincide with any one of said different center frequencies and wherein said passband width is sufficiently wide to select two or more of the multiple optical carrier signals.

* * * * *